US008590993B2

(12) United States Patent
Lee et al.

(10) Patent No.: US 8,590,993 B2
(45) Date of Patent: Nov. 26, 2013

(54) REFRIGERATOR AND RECEPTACLE ASSEMBLY THEREOF

(75) Inventors: In Sub Lee, Suwon-si (KR); Hyun Sang Yoo, Gwangsan-gu (KR); Kook Jeong Seo, Hwanseong-si (KR); Yong Tae Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 64 days.

(21) Appl. No.: 13/373,401

(22) Filed: Nov. 14, 2011

(65) Prior Publication Data

US 2012/0126680 A1 May 24, 2012

(30) Foreign Application Priority Data

Nov. 22, 2010 (KR) ..... 10-2010-0116184

(51) Int. Cl.
*A47B 96/04* (2006.01)
*A47B 96/00* (2006.01)
*A47B 95/00* (2006.01)

(52) U.S. Cl.
USPC ..... 312/404; 312/270.3; 312/302

(58) Field of Classification Search
USPC ..... 312/404, 402, 270.3, 270.1, 291, 302, 312/303, 310, 311, 323
See application file for complete search history.

(56) References Cited

U.S. PATENT DOCUMENTS

| | | | | | |
|---|---|---|---|---|---|
| 1,082,082 | A * | 12/1913 | Jiranek | 108/93 |
| 2,246,342 | A * | 6/1941 | Brown | 62/266 |
| 3,295,904 | A * | 1/1967 | Cobb | 312/270.3 |
| 4,186,978 | A * | 2/1980 | Thomson | 312/321.5 |
| 4,775,075 | A * | 10/1988 | Kamin et al. | 220/815 |
| 4,798,425 | A * | 1/1989 | Armstrong et al. | 312/321.5 |
| 5,694,789 | A * | 12/1997 | Do | 62/441 |
| 5,765,390 | A * | 6/1998 | Johnson et al. | 62/441 |
| 5,947,573 | A * | 9/1999 | Tovar et al. | 312/404 |
| 6,074,030 | A * | 6/2000 | Prunty et al. | 312/404 |
| 6,834,922 | B2 * | 12/2004 | Cho | 312/331 |
| 7,025,321 | B2 * | 4/2006 | Jung | 248/680 |
| 7,350,886 | B2 * | 4/2008 | Antos et al. | 312/404 |
| 2004/0031705 | A1 * | 2/2004 | DeTemple et al. | 206/213.1 |
| 2008/0203876 | A1 * | 8/2008 | Lim et al. | 312/405 |
| 2010/0219731 | A1 * | 9/2010 | Candeo et al. | 312/404 |

* cited by examiner

*Primary Examiner* — Janet M Wilkens
*Assistant Examiner* — Andrew Roersma
(74) *Attorney, Agent, or Firm* — Staas & Halsey LLP

(57) ABSTRACT

A refrigerator including a receptacle provided in a storage chamber of a main body so that the receptacle is moved forward from and backward into the storage chamber, a cover hingedly provided at the receptacle, and an interlocking unit to interlock forward and backward motions of the receptacle and hinged rotation of the cover when the receptacle is moved forward by a predetermined distance.

9 Claims, 11 Drawing Sheets

REFRIGERATOR AND RECEPTACLE ASSEMBLY THEREOF

CROSS-REFERENCE TO RELATED APPLICATIONS

This application claims the benefit of Korean Patent Application No. 2010-0116184, filed on Nov. 22, 2010 in the Korean Intellectual Property Office, the disclosure of which is incorporated herein by reference.

BACKGROUND

1. Field

Embodiments of the present disclosure relate to a refrigerator with an improved structure to open and close a drawer type receptacle.

2. Description of the Related Art

A refrigerator is an apparatus that supplies cool air generated by a refrigeration cycle into a storage chamber to keep various kinds of foods fresh for a long period of time. The refrigerator includes a main body in which the storage chamber is defined and a door to open and close the storage chamber of the main body.

The storage chamber is divided into a refrigerating chamber and a freezing chamber. Foods to be stored in a refrigerated state are placed in the refrigerating chamber, and foods to be stored in a frozen state are placed in the freezing chamber. A receptacle to store vegetables or fruits is additionally provided in the refrigerating chamber.

The receptacle is formed in a drawer type structure so that the receptacle is moved forward from and backward into the refrigerating chamber. A user may pull the receptacle to take out vegetables from the receptacle or put vegetables in the receptacle and may push the receptacle into the refrigerating chamber to store vegetables in a refrigerated state.

SUMMARY

It is an aspect of the present disclosure to provide a refrigerator with an improved receptacle opening and closing structure, thereby improving receptacle closing efficiency, and a receptacle assembly thereof.

Additional aspects of the disclosure will be set forth in part in the description which follows and, in part, will be apparent from the description, or may be learned by practice of the disclosure.

In accordance with one aspect of the present disclosure, a refrigerator includes a main body having a storage chamber, a receptacle provided in the storage chamber of the main body so that the receptacle is moved forward from and backward into the storage chamber, a cover hingedly provided at the receptacle, and an interlocking unit to interlock forward and backward motions of the receptacle and hinged rotation of the cover.

The interlocking unit may include a first interlocking member provided at the main body and a second interlocking member provided at the cover, the first interlocking member being coupled to the second interlocking member to guide the cover so that the cover is hingedly rotated.

The first interlocking member may include a shaft rotatably provided at the main body, a neck extending from the shaft and a head provided at one end of the neck, and the second interlocking member may include a receiving part to receive the head and a slot formed at the receiving part so that the neck extends through the slot.

The head may have a larger size than the slot so that the head does not extend through the slot.

The second interlocking member may further include a movement restriction part to restrict the neck from deviating from the slot.

The movement restriction part may be formed at the rear end of the slot in the direction in which the receptacle is moved forward.

The second interlocking member may further include an opening through which the neck is inserted into the slot.

The opening may be formed at the front end of the slot in the direction in which the receptacle is moved forward.

The first interlocking member may include a guide plane extending upward in the direction in which the receptacle is moved forward, and the second interlocking member may be moved along the guide plane of the first interlocking member.

The guide plane of the first interlocking member may be formed in an arc shape.

The second interlocking member may include a pin or a roller.

The receptacle may include a cover support to hingedly support the cover.

The cover may include a stopper contacting the cover support to restrict hinged rotation of the cover.

In accordance with another aspect of the present disclosure, a receptacle assembly, provided in a storage chamber, includes a case coupled to the storage chamber, a receptacle provided in the case so that the receptacle is moved forward from and backward into the case, a cover hingedly provided at the receptacle, and an interlocking unit to interlock forward and backward motions of the receptacle and hinged rotation of the cover.

The interlocking unit may include a first interlocking member provided at the case and a second interlocking member provided at the cover, the first interlocking member being coupled to the second interlocking member to guide the cover so that the cover is hingedly rotated.

The first interlocking member may include a shaft rotatably provided at the case, a neck extending from the shaft and a head provided at one end of the neck, and the second interlocking member may include a receiving part to receive the head and a slot formed at the receiving part so that the neck extends through the slot.

The first interlocking member may include a guide plane formed at the front end of the case, the guide plane extending upward in an arc shape in the direction in which the receptacle is moved forward, and the second interlocking member may be moved along the guide plane of the first interlocking member.

In accordance with a further aspect of the present disclosure, a refrigerator includes a main body having a storage chamber, a receptacle provided in the storage chamber of the main body so that the receptacle is moved forward from and backward into the storage chamber, a cover hingedly coupled to the receptacle, a first interlocking member provided at the side of the storage chamber of the main body, and a second interlocking member provided at the cover, wherein the first interlocking member is coupled to the second interlocking member to interlock forward and backward motions of the receptacle and hinged rotation of the cover.

The first interlocking member may include a guide plane extending upward in an arc shape in the direction in which the receptacle is moved forward, and the second interlocking member may be moved along the guide plane of the first interlocking member.

The second interlocking member may include a pin or a roller configured to move along the guide plane of the first interlocking member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
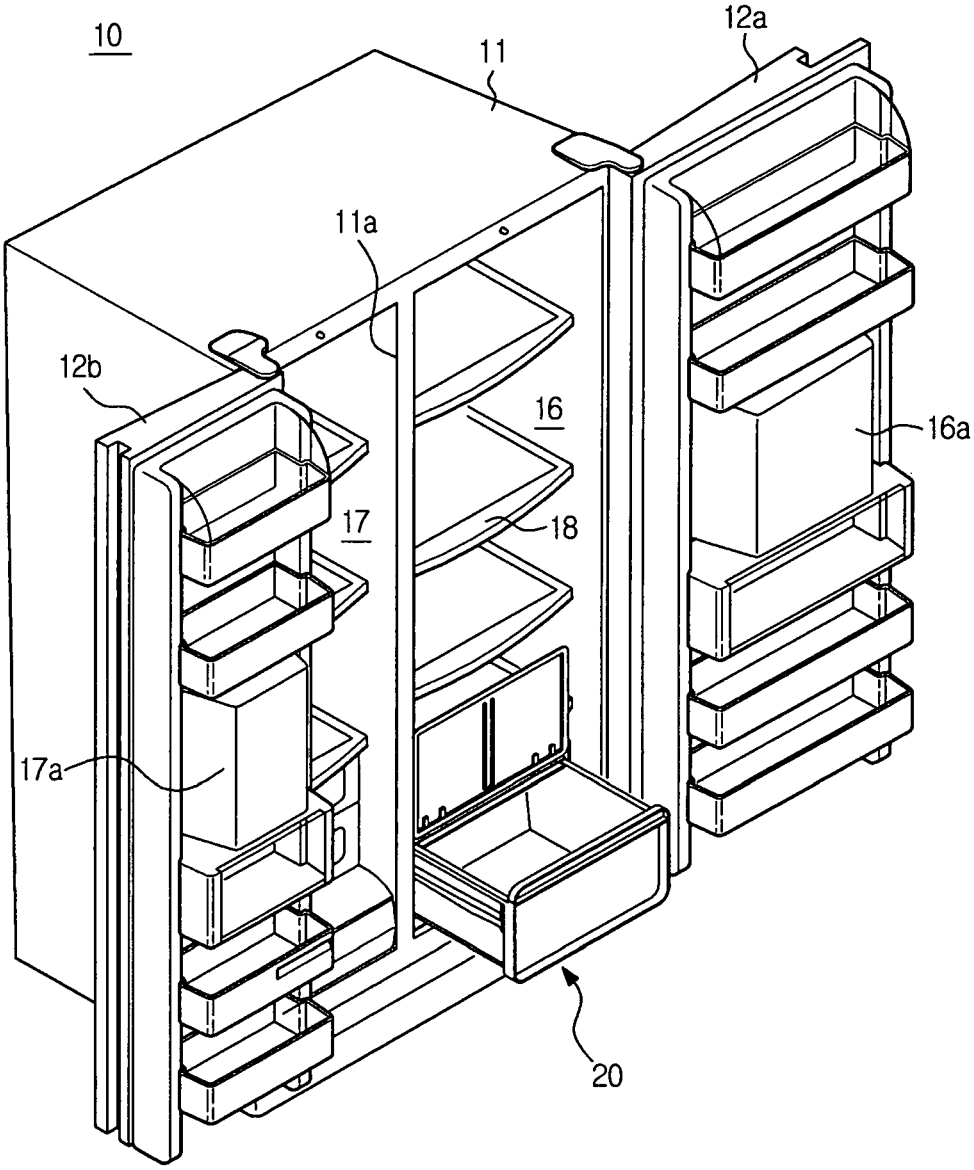
FIG. 1 is a perspective view illustrating the external appearance of a side-by-side refrigerator according to an embodiment of the present disclosure.

Reference will now be made in detail to the embodiments of the present disclosure, examples of which are illustrated in the accompanying drawings, wherein like reference numerals refer to like elements throughout.

Figure 2:
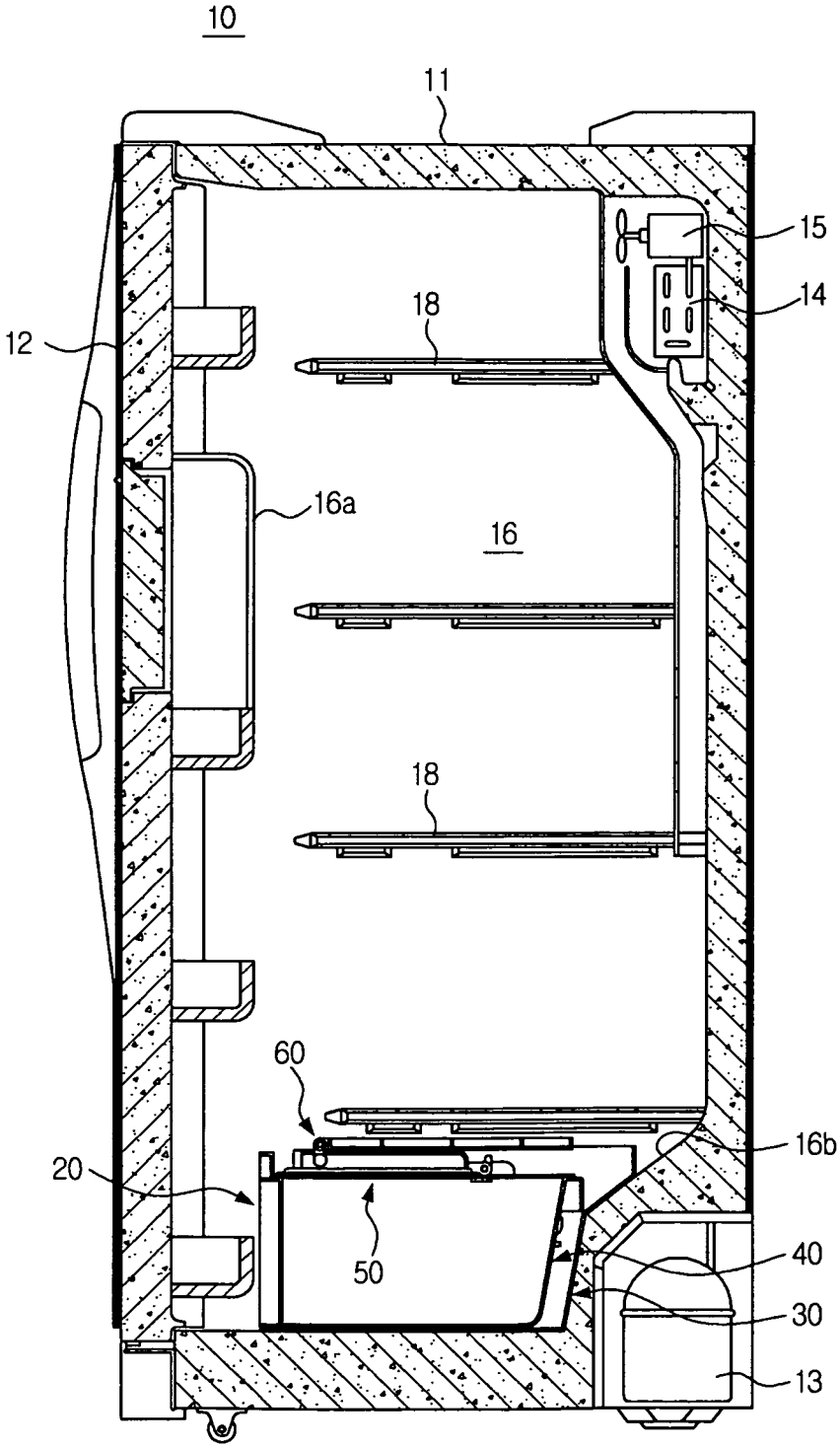
FIG. 2 is a sectional view illustrating the interior of the side-by-side refrigerator according to the embodiment of the present disclosure.

FIG. 1 is a perspective view illustrating the external appearance of a side-by-side refrigerator according to an embodiment of the present disclosure, and FIG. 2 is a sectional view illustrating the interior of the side-by-side refrigerator according to the embodiment of the present disclosure.

As shown in FIGS. 1 and 2, a refrigerator 10 includes a main body 11 and a door 12 hingedly mounted at the main body 11.

The main body 11 may be manufactured in the form of a case having a predetermined storage space defined therein. A refrigeration cycle to supply cool air into the storage space is mounted in the main body 11. The refrigeration cycle may include a compressor 13, an evaporator 14 and a blowing fan 15.

The storage space of the main body 11 may be divided into a refrigerating chamber 16 and a freezing chamber 17 by a middle partition 11*a*.

A plurality of shelves 18 is mounted in the refrigerating chamber 16 and the freezing chamber 17. The shelves 18 may divide the refrigerating chamber 16 and the freezing chamber 17 into a plurality of storage spaces. A user may place foods on the respective shelves 18 so as to store the foods. In particular, an additional receptacle 40 is mounted at the lower part of the refrigerating chamber 16 so that a user may store vegetables or fruits in the receptacle 40.

The door 12 may include a refrigerating chamber side door 12*a* to open and close the refrigerating chamber 16 and a freezing chamber side door 12*b* to open and close the freezing chamber 17. A home bar 16*a* may be mounted at the refrigerating chamber side door 12*a* and a dispenser 17*a* may be mounted at the freezing chamber side door 12*b* so that a user may take out a water bottle or ice using the home bar 16*a* or the dispenser 17*a* without opening the door 12.

Figure 3:
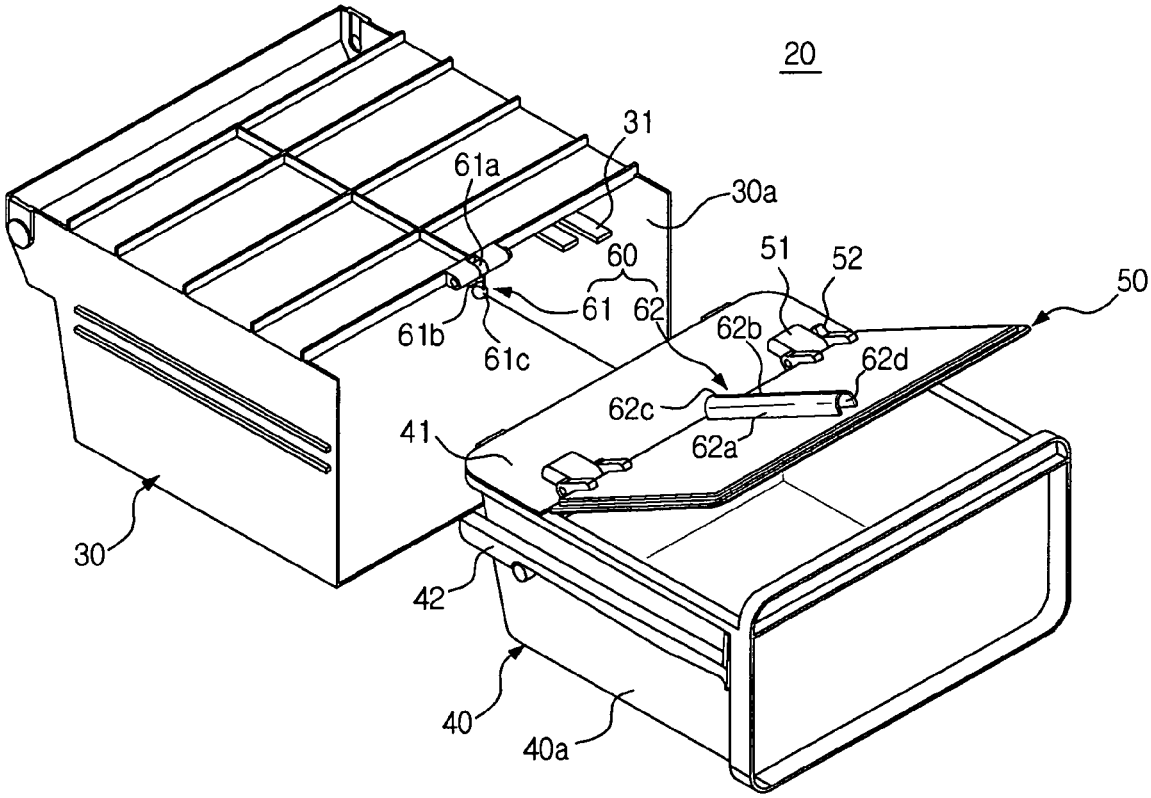
FIG. 3 is an exploded perspective view illustrating a receptacle assembly according to an embodiment of the present disclosure.
Figure 4:
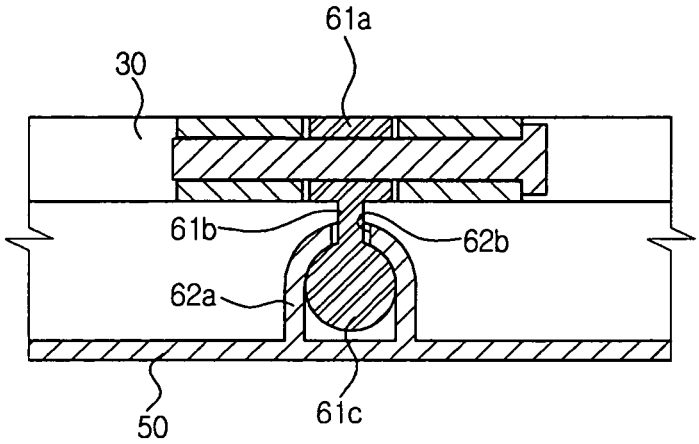
FIG. 4 is a sectional view illustrating the coupling between a first interlocking member and a second interlocking member according to an embodiment of the present disclosure.

FIG. 3 is an exploded perspective view illustrating a receptacle assembly according to an embodiment of the present disclosure, and FIG. 4 is a sectional view illustrating the coupling between a first interlocking member and a second interlocking member according to an embodiment of the present disclosure.

As shown in FIGS. 1 to 4, a receptacle assembly 20 may include a case 30, a receptacle 40, a cover 50 and an interlocking unit 60.

The case 30 may be manufactured so that the case 30 is open at the front thereof. The case 30 may be detachably mounted in the refrigerating chamber 16. A locking structure is provided between the case 30 and the refrigerating chamber 16. The case 30 is fixed to the refrigerating chamber 16 by the locking structure.

In another embodiment, the case 30 may constitute a portion of the refrigerating chamber 16. That is, the case 30 is not separately manufactured so that the case 30 is mounted in the refrigerating chamber 16 but is integrally formed at an inner wall of the main body 11, i.e. an inner wall 16*b* of the refrigerating chamber 16.

The receptacle 40 may be manufactured so that a portion of the top of the receptacle 40 is open, and the remaining portion of the top of the receptacle 40 is closed by a cover support 41. Vegetables or fruits may be put into the receptacle 40 through the open portion thereof.

The receptacle 40 is mounted in the case 30 (or the refrigerating chamber 16) so that the receptacle 40 is moved forward from and backward into the case 30. A user may pull the receptacle 40 to take out vegetables or fruits from the receptacle 40 or put vegetables or fruits in the receptacle 40 and may push the receptacle 40 into the case 30.

Guide rails 31 and 42 may be provided between the receptacle 40 and the case 30 to perform forward and backward motions of the receptacle 40. The first guide rail 31 may be formed at an inner side wall 30*a* of the case 30. The second guide rail 42 may be formed at an outer side wall 40*a* of the receptacle 40. The first guide rail 31 and the second guide rail 42 may engage with each other. For example, the first guide rail 31 may be formed in a groove shape, and the second guide rail 42 may be formed in a protrusion shape.

In another embodiment, in which the case 30 is integrally formed at the refrigerating chamber 16, the first guide rail 31 may be formed at the inner wall of the main body 11, i.e. the inner wall 16*b* of the refrigerating chamber 16.

The cover 50 may be hingedly coupled to the receptacle 40. For example, the cover 50 may be hingedly coupled to the cover support 41 of the receptacle 40 via a hinge unit 51.

The cover 50 covers the open portion of the top of the receptacle 40 to close the inner space of the receptacle 40. As a result, moisture contained in vegetables or fruits stored in the receptacle 40 may be prevented from evaporating and the introduction of cool air into the receptacle 40 may be restrained so that the vegetables or the fruits are kept fresh in the receptacle 40 for a long period of time.

The cover 50 may be automatically opened and closed according to the forward and backward motions of the receptacle 40. When a user pulls the receptacle 40, the cover 50 is hingedly rotated upward to open the corresponding portion of the top of the receptacle 40. When the user pushes the receptacle 40, the cover 50 is hingedly rotated downward to close the corresponding portion of the top of the receptacle 40.

The interlocking unit 60 may interlock the opening and closing motions of the cover 50 and the forward and backward motions of the receptacle 40.

The interlocking unit 60 is provided between the case 30 and the cover 50. The interlocking unit 60 may include a first interlocking member 61 formed at the case 30 and a second interlocking member 62 formed at the cover 50.

In another embodiment, in which the case 30 is integrally formed at the refrigerating chamber 16, the first interlocking member 61 may be formed at the inner wall of the main body 11, i.e. the inner wall 16*b* of the refrigerating chamber 16.

The first interlocking member 61 is coupled to the second interlocking member 62 to guide the cover 50 so that the cover 50 is hingedly rotated. The first interlocking member 61 is coupled to the second interlocking member 62 when the receptacle 40 is moved forward by a predetermined distance because the first interlocking member 61 and the second interlocking member 62 are spaced apart from each other by the predetermined distance in a state in which the receptacle 40 is closed.

The first interlocking member 61 may include a shaft 61*a*, a neck 61*b* and a head 61*c*. The second interlocking member 62 may include a receiving part 62*a*, a slot 62*b*, a movement restriction part 62*c* and an opening 62*d*.

The shaft 61*a* of the first interlocking member 61 is rotatably provided at the case 30. The neck 61*b* extends from the shaft 61*a*. The head 61*c* is provided at one end of the neck 61*b*.

The receiving part 62*a* of the second interlocking member 62 is formed lengthily at the top of the cover 50 in the forward-and-backward direction. The slot 62*b* is formed at the top of the receiving part 62*a* in the longitudinal direction. The movement restriction part 62*c* is provided at the rear end of the slot 62*b*, and the opening 62*d* is provided at the front end of the slot 62*b*.

Since the shaft 61*a* of the first interlocking member 61 is rotatably provided at the case 30, the neck 61*b* and the head 61*c* are inclined downward due to gravity. At this time, the head 61*c* is placed in the receiving part 62*a* of the second interlocking member 62, and the neck 61*b* is placed in the slot 62*b* of the second interlocking member 62. The size of the head 61*c* is larger than the size of the slot 62*b* so that the head 61*c* is prevented from being separated from the receiving part 62*a*.

Also, the cover 50 may be provided with a stopper 52. The stopper 52 may be supported by the cover support 41 of the receptacle 40 during the rotation of the stopper 52 together with the cover 50 to restrict the hinged rotation of the cover 50.

Figure 5:
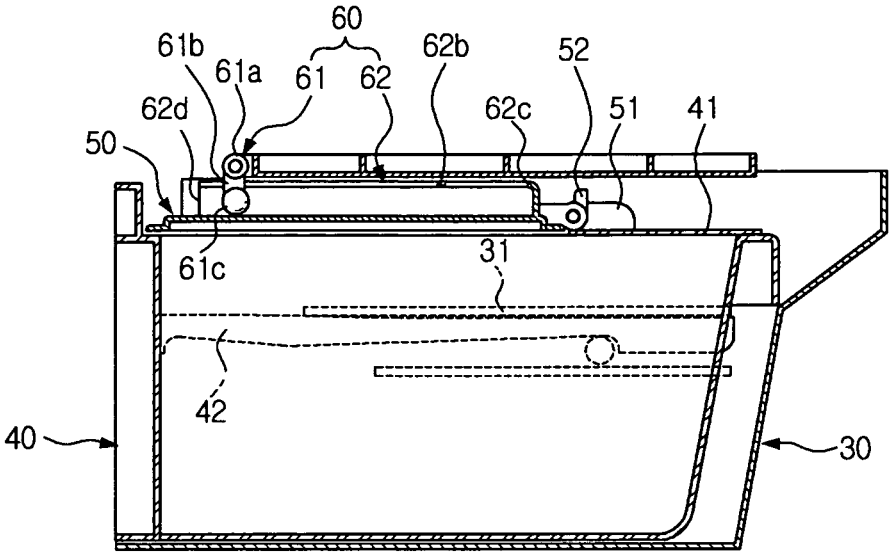
FIG. 5 is a view illustrating a closed state of a cover according to an embodiment of the present disclosure.
Figure 6:
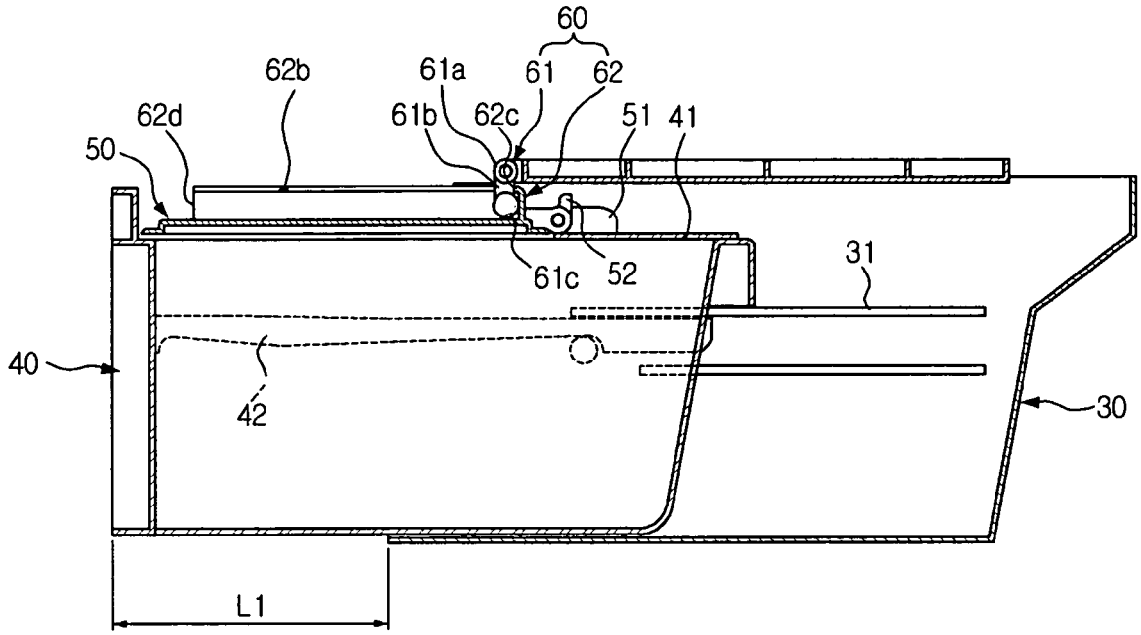
FIG. 6 is a view illustrating a state in which the cover of FIG. 5 starts to be opened.
Figure 7:
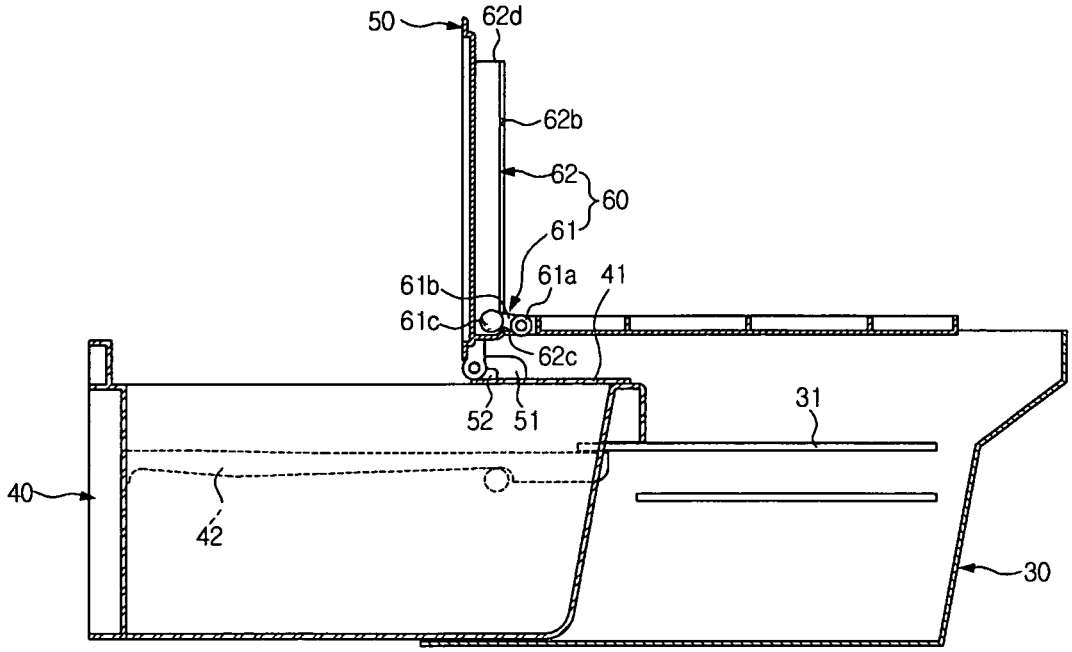
FIG. 7 is a view illustrating a state in which the cover of FIG. 5 is fully opened.

FIG. 5 is a view illustrating a closed state of a cover according to an embodiment of the present disclosure, FIG. 6 is a view illustrating a state in which the cover of FIG. 5 starts to be opened, and FIG. 7 is a view illustrating a state in which the cover of FIG. 5 is fully opened.

As shown in FIG. 5, the cover 50 may close the receptacle 40. In this case, moisture contained in vegetables or fruits stored in the receptacle 40 is prevented from evaporating and cool air is prevented from being directly introduced into the receptacle 40, and therefore, the vegetables or the fruits are kept fresh in the receptacle 40 for a long period of time. At this time, the neck 61*b* of the first interlocking member 61 is located at the front end of the slot 62*b*, i.e. the opening 62*d*, of the second interlocking member 62. The head 61*c* is movably disposed in the receiving part 62*a*.

A user may pull the receptacle 40 to move the receptacle 40 forward from the refrigerating chamber 16. As the receptacle 40 is moved forward from the refrigerating chamber 16, the neck 61*b* of the first interlocking member 61 moves from the front end to the rear end of the slot 62*b* of the second interlocking member 62.

When the receptacle 40 is moved forward from the refrigerating chamber 16 by a predetermined distance L1, as shown in FIG. 6, the neck 61*b* of the first interlocking member 61 is caught by the movement restriction part 62*c* of the second interlocking member 62 with the result that the position of the head 61*c* is in the receiving part 62*a* is fixed, which means that the first interlocking member 61 and the second interlocking member 62 are coupled to each other. The cover 50 may be automatically opened according to further forward movement of the receptacle 40.

When the user further pulls the receptacle 40, the cover 50 is hingedly rotated upward about the hinge unit 51 to open the corresponding portion of the top of the receptacle 40 as the result of the coupling between the first interlocking member 61 and the second interlocking member 62.

When the user continues to pull the receptacle 40, as shown in FIG. 7, the cover 50 is fully opened until the stopper 52 is supported by the cover support 41. The cover opening angle may be set to within 90 degrees so that the cover 50 is hingedly rotated downward due to gravity when the user pushes the receptacle 40 into the refrigerating chamber 16.

Afterwards, the user may push the receptacle 40 into the refrigerating chamber 16. The cover 50 is hingedly rotated downward due to gravity to close the corresponding open portion of the top of the receptacle 40. At this time, the first interlocking member 61 and the second interlocking member 62 are separated from each other. That is, the neck 61*b* of the first interlocking member 61 is separated from the movement restriction part 62*c* of the second interlocking member 62. Subsequently, the receptacle 40 is moved backward by the predetermined distance L1 until the receptacle 40 is fully inserted into the refrigerating chamber 16. At this time, the neck 61*b* is moved to the front end of the slot 62*b*. The head 61*c* is still received in the receiving part 62*a*.

Figure 8:
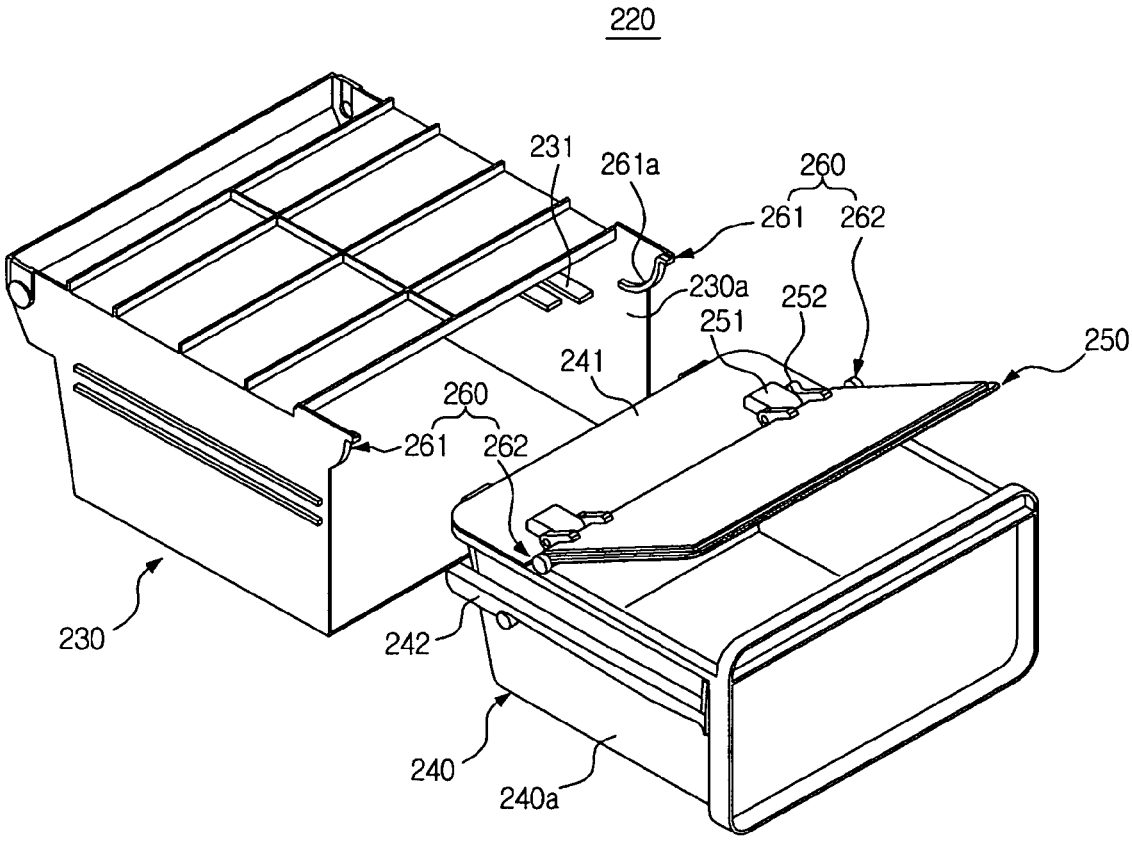
FIG. 8 is an exploded perspective view illustrating a receptacle assembly according to another embodiment of the present disclosure.

FIG. 8 is an exploded perspective view illustrating a receptacle assembly according to another embodiment of the present disclosure.

As shown in FIG. 8, a receptacle assembly 220 may include a case 230, a receptacle 240, a cover 250 and an interlocking unit 260.

Hereinafter, the receptacle assembly 220 will be described based on differences between the receptacle assembly 220 of FIG. 8 and the receptacle assembly 20 of FIG. 3.

The receptacle 240 is mounted in the case 230 so that the receptacle 240 is moved forward from and backward into the case 230. A user may pull the receptacle 240 to take out vegetables or fruits from the receptacle 240 or put vegetables or fruits in the receptacle 40 and may push the receptacle 240 into the case 230.

Guide rails 231 and 242 may be provided between the receptacle 240 and the case 230 to perform forward and backward motions of the receptacle 240. The guide rails 231 and 242 may include a first guide rail 231 formed at an inner side wall 230*a* of the case 230 a second guide rail 242 formed at an outer side wall 240*a* of the receptacle 240.

The cover 250 may be hingedly coupled to the receptacle 240. For example, the cover 250 may be hingedly coupled to a cover support 241 of the receptacle 240 via a hinge unit 251.

The cover 250 covers an open portion of the top of the receptacle 240 to close the inner space of the receptacle 240.

The cover 250 may be automatically opened and closed according to the forward and backward motions of the receptacle 240. When a user pulls the receptacle 240 from the case 230, the cover 250 is hingedly rotated upward to open the corresponding portion of the top of the receptacle 240. When the user pushes the receptacle 40 into the case 230, the cover 250 is hingedly rotated downward to close the corresponding portion of the top of the receptacle 240.

The interlocking unit 260 may interlock the opening and closing motions of the cover 250 and the forward and backward motions of the receptacle 240.

The interlocking unit 260 is provided between the case 230 and the cover 250. The interlocking unit 260 may include a first interlocking member 261 formed at the case 230 and a second interlocking member 262 formed at the cover 250.

The first interlocking member 261 is coupled to the second interlocking member 262 to guide the cover 250 so that the cover 250 is hingedly rotated. The first interlocking member 261 is coupled to the second interlocking member 262 when the receptacle 240 is moved forward by a predetermined distance L2 because the first interlocking member 261 and the second interlocking member 262 are spaced apart from each other by the predetermined distance in a state in which the receptacle 240 is closed.

The first interlocking member 261 is provided at each side of the case 230. The first interlocking member 261 has an arc-shaped guide plane 261*a*. The guide plane 261*a* is curved so as to be upwardly inclined in the direction in which the receptacle 240 is moved forward.

The second interlocking member 262 may protrude outward from each side of the cover 250. The second interlocking member 262 may be formed in the shape of a pin or a roller.

When the first interlocking member 261 is coupled to the second interlocking member 262, the guide plane 261*a* of the first interlocking member 261 guides the second interlocking member 262 so that the second interlocking member 262 is moved upward.

Figure 9:
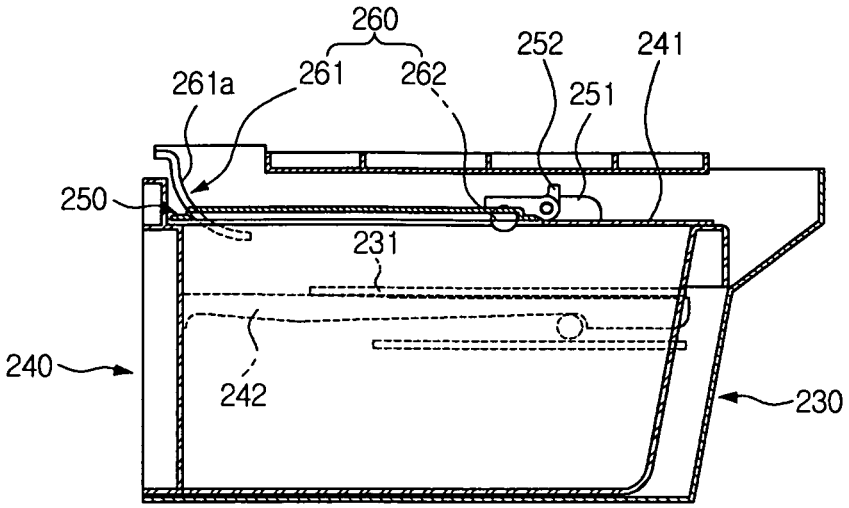
FIG. 9 is a view illustrating a closed state of a cover according to another embodiment of the present disclosure.
Figure 10:
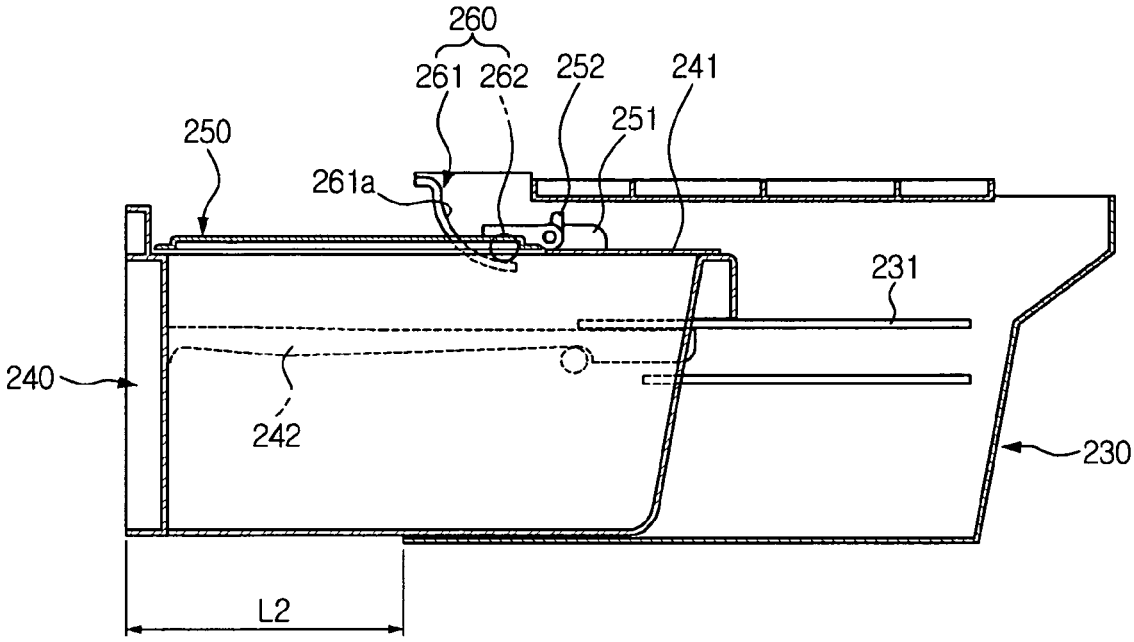
FIG. 10 is a view illustrating a state in which the cover of FIG. 9 starts to be opened.
Figure 11:
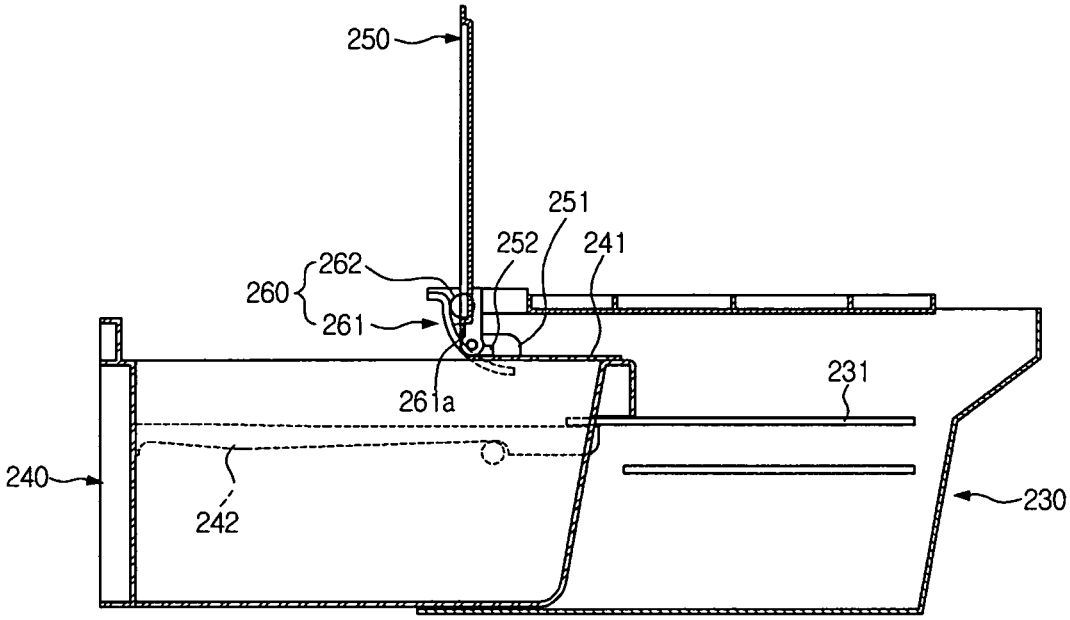
FIG. 11 is a view illustrating a state in which the cover of FIG. 9 is fully opened.

FIG. 9 is a view illustrating a closed state of a cover according to another embodiment of the present disclosure, FIG. 10 is a view illustrating a state in which the cover of FIG. 9 starts to be opened, and FIG. 11 is a view illustrating a state in which the cover of FIG. 9 is fully opened.

As shown in FIG. 9, the cover 250 may close the receptacle 240. In this case, moisture contained in vegetables or fruits stored in the receptacle 240 is prevented from evaporating and cool air is prevented from being directly introduced into the receptacle 240, and therefore, the vegetables or the fruits are stored fresh in the receptacle 240 for a long period of time. At this time, the first interlocking member 261 remains uncoupled from the second interlocking member 262. That is, the second interlocking member 262 remains separated from the guide plane 261*a* of the first interlocking member 261.

A user may pull the receptacle 240 to move the receptacle 240 forward from the case 230. As the receptacle 240 is moved forward from the case 230, the second interlocking member 262 moves to the first interlocking member 261. At this time, the second interlocking member 262 is still separated from the guide plane 261*a* of the first interlocking member 261.

When the receptacle 240 is moved forward from the case 230 by the predetermined distance L2, as shown in FIG. 10, the second interlocking member 262 is located at a start position of the guide plane 261*a* of the first interlocking member 261, which means that the first interlocking member 261 and the second interlocking member 262 are coupled to each other. The cover 250 may be automatically opened according to further forward movement of the receptacle 240.

When the user further pulls the receptacle 240, the cover 250 is hingedly rotated upward about the hinge unit 251 to open the corresponding portion of the top of the receptacle 240 as the result of the coupling between the first interlocking member 261 and the second interlocking member 262. That is, the second interlocking member 262 is guided upward along the guide plane 261*a* of the first interlocking member 261 with the result that the cover 250 is hingedly rotated upward about the hinge unit 251.

When the user continues to pull the receptacle 240, as shown in FIG. 11, the cover 50 is fully opened until a stopper 252 is supported by the cover support 241. The cover opening angle may be set to within 90 degrees so that the cover 250 is hingedly rotated downward due to gravity when the user pushes the receptacle 240 into the case 230.

Afterwards, the user may push the receptacle 240 into the case 230. The cover 250 is hingedly rotated downward due to gravity to close the corresponding open portion of the top of the receptacle 240. At this time, the first interlocking member 261 and the second interlocking member 262 are separated from each other. That is, the second interlocking member 262 is separated from the guide plane 261*a* of the first interlocking member 261. Subsequently, the receptacle 240 is moved backward by the predetermined distance L2 until the receptacle 40 is fully inserted into the case 230.

As is apparent from the above description, the receptacle is automatically opened and closed according to the forward and backward motions of the receptacle, thereby improving convenience in use of the receptacle.

Also, circulation of cool air between the inside and the outside of the receptacle is interrupted, thereby preventing smells of vegetables stored in the receptacle from leaking to the outside.

Also, moisture contained in the receptacle is prevented from evaporating, which helps to maintain high humidity in the receptacle, thereby preventing vegetables contained in the receptacle from drying.

Also, the cover is automatically opened and closed, and thus the receptacle is closed, based on structural shapes of the cover and the case, thereby reducing manufacturing costs.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage chamber;

a receptacle provided in the storage chamber of the main body so that the receptacle is moved forward from and backward into the storage chamber;

a cover hingedly provided at the receptacle; and an interlocking unit to interlock forward and backward motions of the receptacle and hinged rotation of the cover, wherein the interlocking unit comprises a first interlocking member provided at the main body and a second interlocking member provided at the cover, the first interlocking member being coupled to the second interlocking member to guide the cover so that the cover is hingedly rotated, wherein the first interlocking member comprises a shaft rotatably provided at the main body, a neck extending from the shaft and a head provided at one end of the neck, and the second interlocking member comprises a receiving part to receive the head and a slot formed at the receiving part so that the neck extends through the slot.

2. The refrigerator according to claim 1, wherein the head has a larger size than the slot so that the head does not extend through the slot.

3. The refrigerator according to claim 1, wherein the second interlocking member further comprises a movement restriction part to restrict the neck from deviating from the slot.

4. The refrigerator according to claim 3, wherein the movement restriction part is formed at a rear end of the slot in a direction in which the receptacle is moved forward.

5. The refrigerator according to claim 1, wherein the second interlocking member further comprises an opening through which the neck is inserted into the slot.

6. The refrigerator according to claim 5, wherein the opening is formed at a front end of the slot in a direction in which the receptacle is moved forward.

7. The refrigerator according to claim 1, wherein the receptacle comprises a cover support to hingedly support the cover.

8. The refrigerator according to claim 7, wherein the cover comprises a stopper contacting the cover support to restrict hinged rotation of the cover.

9. A receptacle assembly provided in a storage chamber, the receptacle assembly comprising:

a case coupled to the storage chamber;

a receptacle provided in the case so that the receptacle is moved forward from and backward into the case;

a cover hingedly provided at the receptacle; and an interlocking unit to interlock forward and backward motions of the receptacle and hinged rotation of the cover, wherein the interlocking unit comprises a first interlocking member provided at the case and a second interlocking member provided at the cover, and the first interlocking member being coupled to the second interlocking member to guide the cover so that the cover is hingedly rotated, wherein the first interlocking member comprises a shaft rotatably provided at the case, a neck extending from the shaft and a head provided at one end of the neck, and the second interlocking member comprises a receiving part to receive the head and a slot formed at the receiving part so that the neck extends through the slot.

* * * * *

UNITED STATES PATENT AND TRADEMARK OFFICE

CERTIFICATE OF CORRECTION

PATENT NO. : 8,590,993 B2
APPLICATION NO. : 13/373401
DATED : November 26, 2013
INVENTOR(S) : In Sub Lee et al.

It is certified that error appears in the above-identified patent and that said Letters Patent is hereby corrected as shown below:

On the Title Page, Item (75) (Inventors), Line 3, Delete "Hwanseong-si" and insert -- Hwaseong-si --, therefor.

Signed and Sealed this
Twenty-fifth Day of March, 2014

Michelle K. Lee

Michelle K. Lee
*Deputy Director of the United States Patent and Trademark Office*